United States Patent [19]

Monaghan

[11] Patent Number: 4,709,676

[45] Date of Patent: Dec. 1, 1987

[54] FUEL SUPPLY SYSTEM FOR TURBOCHARGED INTERNAL COMBUSTION ENGINE

[75] Inventor: Michael L. Monaghan, Shoreham-By-Sea, England

[73] Assignee: Ricardo Consulting Engineers plc, West Sussex, England

[21] Appl. No.: 852,135

[22] Filed: Apr. 15, 1986

[30] Foreign Application Priority Data

Apr. 15, 1985 [GB] United Kingdom ..... 8509558

[51] Int. Cl.[4] ..... F02M 39/00

[52] U.S. Cl. ..... 123/383; 123/502

[58] Field of Search ..... 123/383, 500, 501, 502, 123/449, 382, 380, 373

[56] References Cited

U.S. PATENT DOCUMENTS

| | | | |
|---|---|---|---|
| 4,469,066 | 9/1984 | Yuzawa | 123/502 |
| 4,534,329 | 8/1985 | Filtri | 123/383 |
| 4,538,581 | 9/1985 | Hakansson | 123/502 |
| 4,590,913 | 5/1986 | Faupel | 123/502 |

FOREIGN PATENT DOCUMENTS

| | | | |
|---|---|---|---|
| 0106136 | 6/1983 | Japan | 123/383 |
| 857295 | 12/1960 | United Kingdom | 123/500 |

*Primary Examiner*—Carl Stuart Miller

*Attorney, Agent, or Firm*—Price, Heneveld, Cooper, DeWitt & Litton

[57] ABSTRACT

An improved fuel supply system for a turbocharged diesel engine, of the general type comprising a fuel pump which conveys fuel at an intermediate pressure to a high-pressure distributor which has a fuel-injection timing piston that adjusts the injection timing as a function of the intermediate fuel pressure. The improved system includes a control unit which reduces the pressure applied to the timing piston when the engine is subjected to a demand for increased fueling at low turbocharger boost pressures. This causes the injection timing to be retarded, which in turn increases the exhaust temperature and pressure and, thus, increases the turbocharger boost pressure. After a controlled interval during which boost pressure has risen the desired amount, the control unit allows the pressure applied to the timing piston to rise back to its former value, whereupon the injection timing returns to normal.

13 Claims, 5 Drawing Figures

FUEL SUPPLY SYSTEM FOR TURBOCHARGED INTERNAL COMBUSTION ENGINE

BACKGROUND OF THE INVENTION

The present invention relates to a fuel supply system for a turbocharged internal-combustion engine, for example an indirect-injection turbocharged diesel engine.

Turbocharged engines tend to suffer an acceleration lag as the turbocharger speeds up to a value where it can develop the boost demanded. This problem is particularly acute with diesel engines, where low exhaust temperatures at an initial low load level and the action of the boost control unit combine to limit the rate at which the increased energy required to produce turbocharger acceleration can be made available in the exhaust gases. The temperature of the exhaust gases and their release pressure can be increased by retarding the fuel-injection timing, but this has the effect of worsening fuel consumption and, with most diesel engines, causing excessive exhaust smoke. The inconvenience of this transient turbocharger lag problem is most troublesome in diesel-powered passenger cars, where continuous changes of load and speed are required in traffic.

Indirect-injection combustion systems are generally used for diesel-engined cars. These systems have the feature that as much as 60% of the combustion chamber space at firing TDC is contained in a cell which is separate from the volume in or immediately above the piston crown. Such separate cells are usually spherical in shape and air is forced into them by the piston, via a tangential throat, during the compression stroke. Combustion is initiated and sustained by the timed injection of fuel into the combustion cell.

In one known distributor-type fuel-injection pump which is used on small, high-speed diesel engines, the driving shaft (operating at half engine crankshaft speed, as is usual for a 4-stroke engine) drives a vane-type fuel pressurizing pump and, via splines, also rotates a single high-pressure distribution plunger. The plunger has a timed reciprocating axial movement superimposed on its rotary motion by a system of rotating cams and relatively fixed rollers.

The vane pump compresses the fuel to an intermediate pressure and is connected to an inlet port in the distribution plunger casing. The motion of the plunger causes fuel to be entrapped and sequentially delivered to each cylinder in turn at the appropriate time. The injection period has a fixed start point but a variable ending, depending upon a control setting which may be determined by a fuel control lever, or by a governor if under automatic control.

Since the volume of fuel delivered by the vane pump increases with speed, the intermediate pressure generated also rises (within the parameters set by the relief valve). Use is made of this rising intermediate pressure with speed to adjust the angular position of the fixed rollers in order to advance the start of fuel injection as the engine speed rises. This characteristic frequently suits combustion requirements.

In another known distributor-type fuel injector pump, a central shaft or rotor of significant diameter is driven at half engine speed. Two opposing pump plungers are located in radial bores in the rotor. These plungers are forced outward by the centrifugal force generated by rotation of the rotor, and they are moved radially inward by a fixed cam ring located around the rotor, the cams being so shaped as to provide the desired fuel injection rate.

A vane pump also driven by the rotor supplies fuel at an intermediate pressure to a passage having a spring-loaded relief valve at one end and a metering valve at the other. The metering valve has the controlled pressure from the vane fuel pump acting on one end of its plunger while the other end thereof bears against a spring whose opposite end is positioned by a control lever operated by either a governor or the accelerator pedal. Thus, the position of the metering valve is controlled by the load-dependent spring at one end and the intermediate level of pressure delivered by the pump, which is fixed by the pressure relief valve. The metering valve delivers fuel to an inlet in the rotor casing and, via a series of passages in the rotor, fuel is conveyed sequentially to the space between the plungers. The plungers sequentially pressurize and deliver the fuel, via an outlet in the rotor and a series of outlets in the rotor casing, to the different cylinder fuel-injector nozzles.

The metering valve determines, for a fixed transfer pressure, the rate at which fuel enters the high-pressure pumping space between the two radial plungers in the time available between successive injections. Angular movement of the rotor cuts off the single inlet just before the cam forms start to move the plungers radially inward. Depending on the degree to which the space between the plungers has filled with fuel, a point is reached as the plungers lift when any empty space has been reduced to zero and the fuel becomes "solid," whereupon its pressure rises with further inward movement of the plungers. At this point, the single outlet at the far end of the rotor overruns one of the fuel delivery outlets in the casing so that the now-pressurized fuel is then delivered to the appropriate engine cylinder.

It is clear that at small fuel deliveries the plungers will have lifted some way towards their innermost position before the entrapped fuel becomes "solid" and its pressure rises. As a result, the start of injection is later at light engine loads than at full load, i.e., the start of injection varies with load. Delivery ends when the plungers reach the tops of the cams, i.e., the timing of the end of injection is constant with respect to the cam lift.

In practice, the "fixed" cam ring is angularly located by a lever whose position is determined in dependence upon the reaction to the driving torque imposed on the cam ring. Thus, the greater the quantity of fuel injection, the greater the torque reaction and the greater the angular movement of the cam ring against the resisting torque imposed by a spring. Dependent on the spring load and rate, the actual start of injection can be varied as required with engine load to give, for example, a constant start of injection timing with respect to engine TDC.

In addition, since the pressure delivered by the vane pump is dependent on the fuel quantity pumped by its rotor, varying directly with engine speed and with the characteristics of the relief valve spring rate and opening area, the fuel transfer pressure rises with engine speed. Consequently, the position of the cam ring is speed-sensitive and as a result injection can be advanced with speed, as desired.

So far the operation of these pumps has been briefly described for a normally-aspirated engine, for which a fixed stop is used to limit the maximim quantity of fuel which can be injected, to avoid excessive exhaust smoke. In the case of a boosted engine, the maximum amount of fuel which can be burned increases with the boost pressure, so it is usual to have a device operated by the boost pressure which automatically alters the fuel pump maximum delivery stop in accordance with the prevailing manifold boost pressure.

SUMMARY OF THE INVENTION

Broadly stated, it is an object of the present invention to minimize the acceleration lag in a turbocharged engine without significantly adversely affecting fuel consumption and without causing excessive exhaust smoke.

According to the invention there is provided a fuel supply system for a turbocharged internal-combustion engine which comprises a fuel pump, a fuel distributor arranged to supply a predetermined quantity of fuel sequentially to individual injectors associated with each cylinder, and means to retard the timing of the fuel injection for a specific period when the engine is subjected to a demand to increase fuelling.

It is a feature of the indirect-injection engines, as mentioned above, that it is possible to retard the fuel-injection timing by as much as five degrees (with respect to crankshaft position) at full load without any adverse effect as regards exhaust smoke but with an increase in exhaust temperature of about 100 degrees K. At the same time, the exhaust release pressure is increased. This means that more energy is available in the exhaust gases to drive the turbine of the turbocharger. If such a retardation of the fuel-injection timing is made for a short period of time, the transient response and acceleration of the turbocharger can be improved to make significantly more power available for vehicle acceleration.

Thus, in accordance with the present invention means are provided to retard the fuel-injection timing by on the order of five degrees under circumstances when it is required to provide extra energy to accelerate the turbocharger, whereby transient response of the turbocharger is much improved. This extra energy may be required, for example, when the driver is demanding more torque than the engine will supply when naturally aspirated, or under low boost conditions, and when the engine, and vehicle, are required to accelerate strongly.

The retardation of injection timing in accordance with the invention is only required for a short period of time, during which the turbocharger rapidly accelerates to its desired operating speed. Prolonged operation at the retarded timing would adversely affect the engine's fuel consumption. Currently, most popular diesel fuel-injection pumps use hydraulic means to vary the injection timing with steady-state loads and speeds. However, a similar approach may be used to obtain temporary retardation of injection timing in accordance with the present invention, and this result may also be obtained where electronic control of fuel-injection equipment is used (which has recently become possible), under which conditions it is relatively simple to program the required effect.

Accordingly, in accordance with the present invention, when the driver demands an acceleration involving the turbocharged area of operation, the injection timing is retarded by, for example, on the order of five degrees. A time-delay is preferably built into the injection-retard mechanism, or instruction, varying typically from 5 seconds at 20 rev/s engine speed to 0.5 seconds at 70 rev/s. This ensures that fuel economy is not significantly affected since the retardation only occurs for a very short time during transient operation.

The present invention may also be adapted to permit similar transient retardation of fuel-injection timing when conventional non-electronic-controlled fuel-injection pumps are used.

The descriptions of distributor-type fuel-injection pumps set forth above are of those systems in which the start of end of injection based on the cam lift is variable depending on the fuel delivery quantity, at any fixed speed, but with means provided to automatically readjust the angular position of the cam ring driving the plungers in order to retain the desired injection advance angle in relation to the engine TDC position.

Thus, in a preferred embodiment according to the invention, the intermediate pressure, sometimes called the transfer pressure, is used to alter the angular position of the cam ring or, in other designs, that of the cam-follower rollers. In this way, the start of injection is retarded for a time when a marked increase in fuelling is suddenly demanded, so that exhaust-release temperatures and pressures are higher than usual in order to help increase the turbocharger speed, to thereby provide the increased boost, and hence power output, demanded by the vehicle driver.

Thus, according to another aspect of the present invention there is provided a fuel supply system for a turbocharged diesel engine which comprises a fuel pump arranged to convey fuel at an intermediate pressure via a control valve to a high-pressure fuel distributor, the distributor being arranged to supply a predetermined quantity of fuel sequentially to individual injectors associated with each cylinder, the system further including a timing-control device for adjusting the timing of the fuel injection, and a control unit, the control unit having means for conveying the intermediate fuel pressure to the timing-control device under normal engine working conditions and for diverting the intermediate fuel pressure for a predetermined period when the engine is subjected to a demand for increased fuelling, thereby reducing the pressure conveyed to the timing-control device which, as a result, retards the timing of the fuel injection.

Preferably, the fuel distributor is of the plunger type, whose timing is determined by the position of a cam system, and in which the timing-control device comprises a piston arranged to move the cam system, against the resistive force of a spring, in accordance with the pressure from the control unit, which is applied to the piston. The control unit preferably includes a fuel passageway having an inlet connected to the fuel pump outlet, an outlet connected to the timing-control device, a bypass outlet, and a valve member, the valve member being movable between a normally-closed position in which it isolates the bypass outlet from the inlet, and an open position in which the inlet and bypass outlet are connected together in flow communication.

In one of the standard methods of controlling the fuelling of an engine which is turbocharged, a diaphragm-type sensor has the boost or inlet manifold pressure applied to one side of the diaphragm while the other side thereof is subject to the combination of atmospheric pressure and a bias or load produced by a helical spring. Thus, depending on the diaphragm area and the spring characteristics chosen, the diaphragm moves in direct proportion to the difference between boost pressure and atmospheric pressure. A control member is coupled to the atmospheric side of the diaphragm, such member having a prearranged taper or other cam face, which may be linear or non-linear. Normally, a rounded end portion of a rocking lever having a fixed fulcrum is caused to bear against the tapered face of the control member. The opposite end of such rocking lever is arranged to move in response to either the operator's control (which may be a hand control, foot lever, etc.) or the output sleeve of a governor. Thus, in a standard system of this type, the maximum fuel quantity which can be injected is determined, and limited, by the initial setting of the operator's control plus the position of the rounded end portion of the rocking lever along the tapered face of the control member, which position is determined by the prevailing amount of boost or inlet manifold pressure.

Thus, in accordance with known systems, a turbocharger boost-pressure sensor unit has an output member that moves in response to the amount of boost pressure actually existing, and such output member comprises a control shaft which operates in accordance with rising boost pressure, after a demand to increase fuelling, to ultimately (but gradually) cause movement of the fuel control valve member from the open position (in which the fuel pump inlet is connected to the bypass outlet) to the closed position (in which the pump inlet is disconnected from the bypass outlet).

In one preferred constructon of the present invention, the system includes a pivotal control lever whose fulcrum point is movably carried on an arm which constitutes the actuating valve member of a control unit. One end of the pivotal control lever is coupled to the fuel control valve actuator, which is moved by the engine accelerator control, the fuel control valve actuator being arranged to act on the pivotal lever when the accelerator is moved in a manner calling for the fuel control valve to open, i.e., upon demand for increased fuelling, while the other end of the pivotal lever is coupled to the output shaft of the boost-pressure-sensing unit, which is arranged to act on the pivotal lever so as to cause the fuel control valve member to return to the closed position as the boost pressure subsequently rises. Due to the movable fulcrum provided for the pivotal lever by the control unit operating valve, pivotal movement of such lever in response to accelerator position and boost pressure, in the manner just described, results in repositioning of the fulcrum point, and thus of the control unit operating valve, thereby operating the control unit so as to cause it to initiate a corresponding change (e.g., retardation) in the timing of the injection pulses.

In an alternative construction, the system preferably includes an actuator connected to the engine accelerator control and a valve member which comprises a main plunger and a secondary plunger interacting with the main plunger to define the open and closed valve positions, the actuator being arranged to urge the secondary plunger to the pen position upon accelerator movement of the type calling for an increase in fuelling, while the shaft of the boost-pressure-sensor unit is arranged to move the main plunger to the closed-valve position as the boost pressure subsequently rises.

Preferably the system includes a timing, or time-delay, apparatus which returns the injection timing to its normal condition after a predetermined brief interval. For example, this may comprise a piston located in a bore in the control unit which is spring-loaded towards a position in which it closes the fuel passageway which controls the injection-timing control device, such piston being arranged to move against a biasing spring to a passageway-opening position as a function of the increase in pressure within the passageway.

DESCRIPTION OF THE PREFERRED EMBODIMENTS

Figure 1:
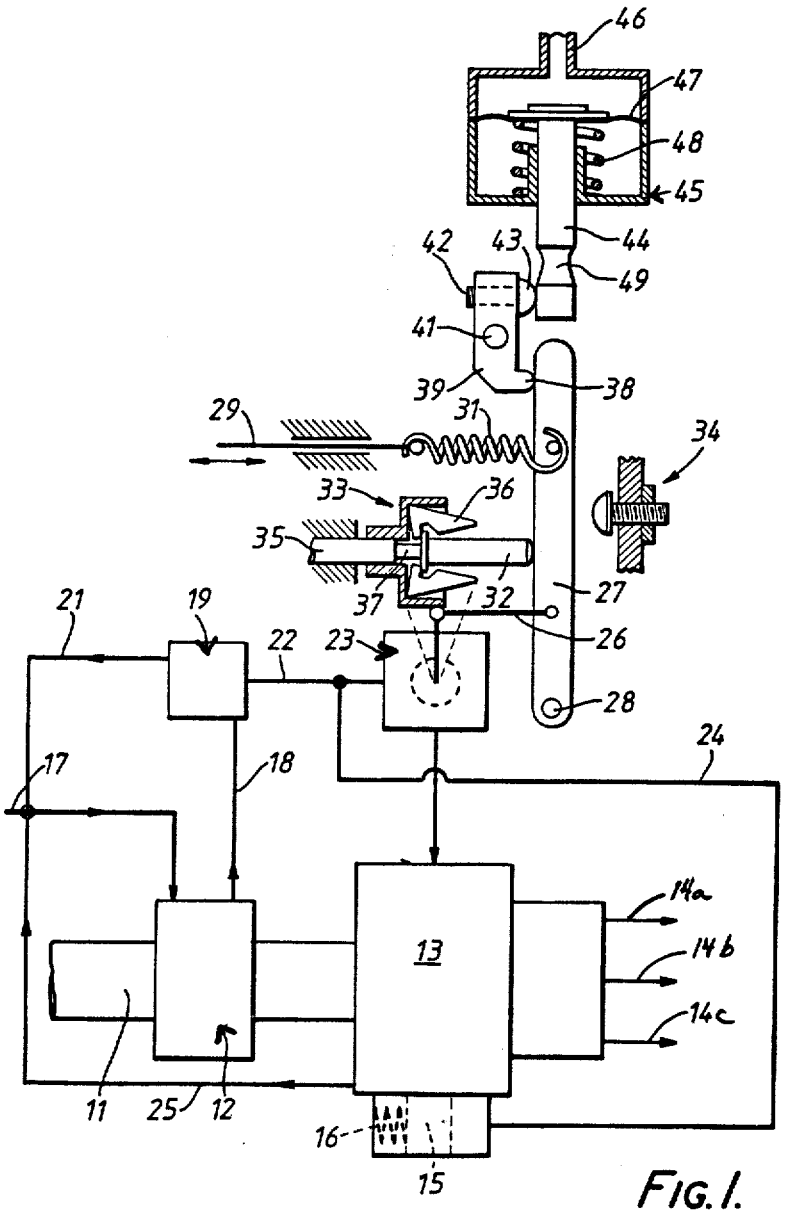
FIG. 1 is a schematic diagram of a known fuel supply system in a turbocharged indirect-injected diesel engine.

FIG. 1 shows diagrammatically the general arrangement of a known distributor-type fuel-injection system. The system essentially consists of a drive shaft 11 which drives a vane-type medium-pressure fuel pump 12 and a high-pressure plunger-type fuel distributor 13. The distributor 13 has a series of outlets **14*a*, 14*b*, 14*c*, etc., one for each engine cylinder (not shown), and an injection timing device in the form of a piston 15 which operates against a spring 16. The outlets 14*a*, 14*b***, etc., are each connected to a different one of the cylinder fuel injectors (not shown) via high-pressure piping.

In operation, fuel is supplied through a conduit 17 from the fuel tank, usually via a low-pressure lift pump, and passes to the medium-pressure pump 12. Within the pump 12, the fuel pressure is raised to an intermediate value and is then pumped out via line 18 to a pressure-relief valve 19 containing a spring-loaded plunger which determines the delivery pressure from the pump 12. Excess relieved fuel returns via a line 21 to the fuel supply 17. The controlled-pressure fuel passes via a line 22 to a fuel control valve 23 and also by a line 24 to the timing control piston 15. Any leakage and lubricating fuel oil from within the pump casing is returned to the fuel supply 17 via a line 25.

Since the volumetric delivery of the medium-pressure pump 12 rises with engine speed, the pressure present at the downstream side of the relief valve 19 tends to rise, to a degree dependent upon the spring bias and discharge characteristics within the relief valve 19. This rise in pressure is used to control the injection timing advance with speed by means of the intermediate pressure acting on one side of the piston 15, which is opposed by the spring 16. The position to which the piston 15 is moved as a result of the two opposing forces just noted determines the angular position of the pump cam ring for one known type of pump or the angular position of the cam-followers for another known type. The net result is to vary the angle with respect to crankshaft position (i.e., the timing) at which fuel injection starts.

The control of the injection quantity per cycle is accomplished by means of the control valve 23. The particular constructional details of this component will depend upon the particular type of pump selected, of which several are known; basically, however, the movement of the control valve 23 determines the amount of fuel trapped by the high-pressure injection plunger(s) of the distributor.

The position of the control valve 23 is adjusted by means of a linkage 26 which is connected to a lever 27 having a fixed pivot 28. A control rod 29 is connected at one end to the lever 27 by a spring 31, and the rod 29 is arranged to be moved by a driver's foot pedal (accelerator); alternatively, lever 27 may be moved by the output rod 32 from a governor 33. The spring 31 returns the system to an idle fuel setting when the control rod 29 is relaxed. The idling fuel is set by means of an adjustment stop 34.

The governor 33 is driven by a rotary shaft 35 which is gear-driven from the pump shaft 11, and the governor has fly-weights 36 bearing in a conventional manner on a slider shaft 37. The output rod 32 of the slider 37 bears on the lever 27, and the control force exerted by the weights 36 is opposed by the spring 31 via the lever 27 and the slider 37. The force exerted by spring 31 is determined by the control load applied to rod 29, which is controlled either directly or indirectly via a further lever or eccentric in a known manner.

The end of lever 27 remote from its pivot 28 bears on the curved end 38 of a further lever 39 which has a fixed pivot 41. The opposite end of the lever 39 is fitted with a screw adjustment 42 whose end 43 abuts against a spindle 44 which protrudes from a boost-sensor unit 45. In the boost-sensor unit 45, boost (manifold) pressure is applied at 46 to the top side of a diaphragm 47 in opposition to a spring 48. Thus, the spindle 44 moves in and out to a degree determined by the diaphragm area and the spring load and rate. With no boost, i.e., with the engine naturally aspirated, the spindle 44 will take up the position indicated in FIG. 1 with the abutment 43 of the lever 39 disposed against the lower portion of the spindle 44, which is parallel-sided. This setting determines how much fuel can be injected with no boost, the specific amount being set up by the adjustment screw 42. With boost present, the spindle 44 moves down so that the abutment 43 of the lever 39 contacts a tapered portion 49 on the spindle 44, allowing the lever 39 to move further in a clockwise direction (as shown in FIG. 2), which allows more fuel to be injected.

Figure 2:
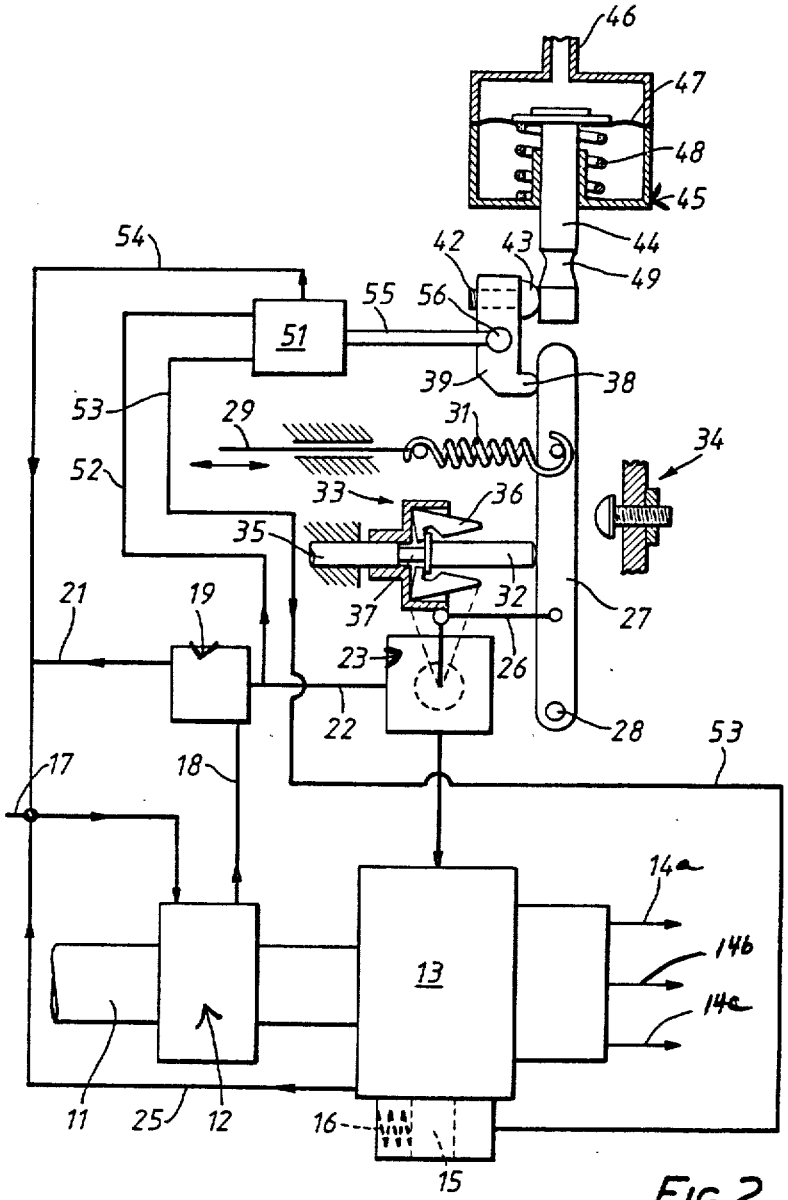
FIG. 2 is a schematic diagram similar to FIG. 1 but modified in accordance with the present invention.

FIG. 2 shows the way in which the system of FIG. 1 can be modified in accordance with the present invention. More particularly, in accordance with the invention, the conventional direct connection between the fuel lines designated 22 and 24 in FIG. 1, at a point located immediately downstream from pressure-relief valve 19, is eliminated and a control unit 51 is, in effect, connected between these lines. Thus, the control unit 51 has an inlet line 52 which extends from the intermediate pressure line 22, and an outlet line 53 which is coupled to the piston 15, replacing the line 24 in FIG. 1. In addition, the control unit 51 has a fuel bypass line 54 leading back to the fuel supply 17, and a control rod 55, which extends outwardly from control unit 51 and is attached to the lever 39 by a pivot 56. The pivot point (i.e., fulcrum) position for lever 39 is thus made to be movable in character, replacing the fixed pivot 41 found in conventional systems, as shown in FIG. 1, so that the lever 39 is made capable of undergoing translational movements.

The control unit 51 operates as follows. With the engine in the unboosted condition, an increase in fuel demand by the driver will mean that the lever 27 will be moved clockwise about the pivot 28 and the abutment 43 will contact the spindle 44 as thelever 39 pivots about the pivot 56. The application of greater force on the control rod 29 will mean that the lever 39 and the pivot 56 will now move to the left against a spring load contained in the control unit 51. The immediate effect of this is to release the intermediate or transfer pressure reaching the control unit 51 via the line 52, bypassing fuel back to the fuel supply 17 via the bypass line 54. As a result of this, the pressure in line 53 is lowered temporarily, whereby the load on the timing control piston 15 is reduced. This causes the injection timing to be retarded.

Thus, a sudden demand to increase fuelling immediately causes the injection timing to be retarded, which in turn increases the temperature and pressure of the exhaust gases. This causes an immediate increase in the turbocharger boost pressure, and rapid futher increase in boost, thereby minimizing the characteristic turbo boost time lag.

The increase in turbocharger boost pressure just described causes the spindle 44 to move down, with the result that the abutment 43 encounters the tapered portion 49. This causes the lever 39 to pivot upon its curved end 38, due to the spring bias applied by the control unit 51, so that the control rod 55, and movable pivot 56, move back toward the right and the injection timing returns to normal.

Figure 3:
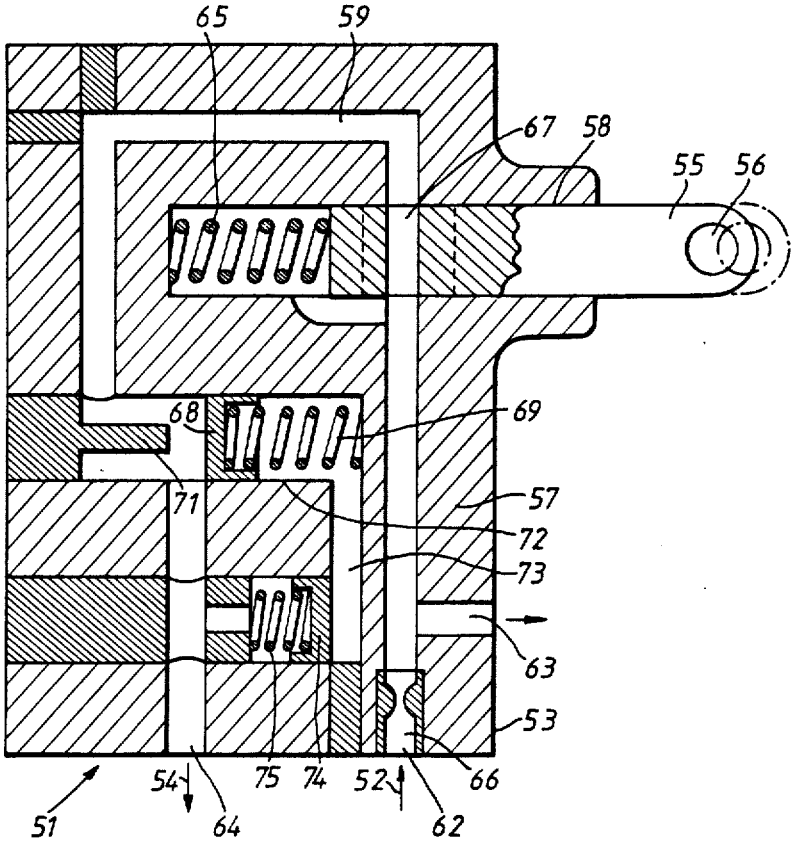
FIG. 3 is a diagrammatic section through one embodiment of a control unit.

One preferred construction of the control unit 51 is shown in detail in FIG. 3. As shown here, the control unit comprises a housing 57 having a bore 58 which slidably receives the control rod 55, which bottoms against a biasing spring 65. Control unit 51 additionally has a fuel passageway 59 which has an inlet 62 that communicates with the inlet line 52, an outlet 63 which communicates with the outlet line 53, and a bypass outlet 64 which communicates with the bypass line 54.

The control rod 55 is normally urged to the position shown in broken lines by spring 65, such that under normal conditions passageway 59 is closed and the intermediate pressure from line 52 is therefore conveyed via the inlet 62 and a flow restrictor 66 to the outlet 63 and, via the line 53, to the injection timing control piston 15. However, when the control rod 55 is moved to the left (as shown in FIG. 3) by the action of the driver demanding a sudden increase in fuelling, it takes up the position shown in solid lines in FIG. 3. As a result, a passage 67 in the control rod 55 becomes aligned with and opens the passageway 59, allowing fuel to flow via the bypass outlet 64 and the bypass line 54 back to the fuel supply 17. As stated above, this reduces the pressure at the injection timing control piston 15 and so retards the injection timing.

To improve the rate at which the pressure drops at the outlet 63 of control unit 51, and hence improve the rate at which the pressure drops at the injection timing control piston 15, in order to give a rapid timing change when required, a piston 68 is provided in a bore 72 and arranged so that it normally closes passageway 59. That is, piston 68 is normally urged to the left (as shown in FIG. 3) by a biasing spring 69, so that the piston rests against a stop projection 71. The piston 68 is moved to the right when the pressure in passageway 59 suddenly rises, to thereby help to drop the prevailing pressures. Fuel (oil) trapped behind (to the right of) piston 68 would normally prevent its rapid movement to the right, but this is avoided by means of a relief passage 73 leading to another spring-loaded piston 74, which will move to the left against the light spring force exerted by a spring 75, to thereby accommodate, temporarily, the fuel displaced by the movement of piston 68. Piston 68 is arranged to have either a loose fit in its bore 72, or a small bleed hole may be drilled through it, or a small bypass groove machined or otherwise formed in it, with the result that after the initial movement of this piston due to the sudden arrival of the pressure wave, controlled leakage will cause the piston 68 to move back to the left at a predetermined rate until the piston ultimately seats on the projection 71 to seal off the bypass flow. When this happens, the pressure at the outlet 63 will rise, causing the injection timing to be advanced back to its normal steady-state setting. Thus, the injection timing is suddenly retarded and then slowly creeps back to its normal steady-state setting at a predetermined rate, dependent upon the amount of leakage provided.

As mentioned briefly above, the increased temperature and pressure in the engine cylinders resulting from the retarded injection timing provide a larger amount of exhaust energy than usual to increase the rate of acceleration of the turbocharger rotor system. Thus, the additional boost required to provide the additional engine torque demanded is reached more quickly than would otherwise occur. With the rise in boost pressure, the spindle 44 moves under the influence of the diaphragm 47, allowing the abutment 43 on the lever 39 to move to the right as drawn in FIG. 2. This reduces the load on the pivot 56, which then moves to the right under the influence of spring 65 acting on the control rod 55. When the control rod 55 has moved to the broken-line position shown in FIG. 3, the passage 67 will have moved into the bore 58 to seal off any flow of pressurized fuel to the passageway 59. Thus, the pressure at outlet 63 will rise and remain at the normal intermediate or transfer pressure.

Figure 4:
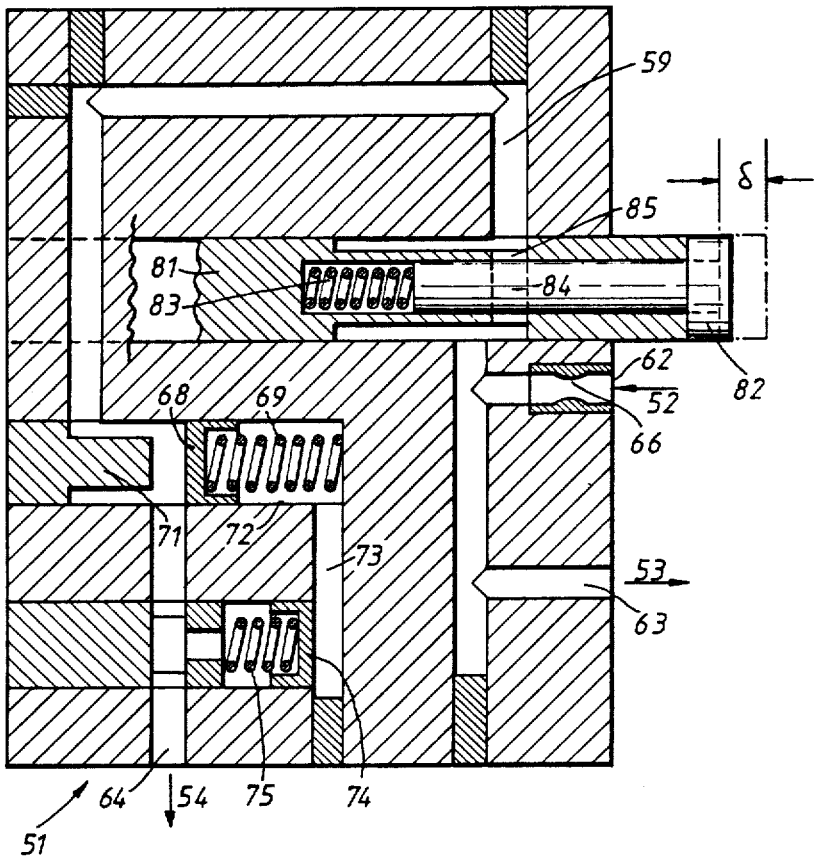
FIG. 4 is a sectional view similar to FIG. 3 but showing a second embodiment.

FIG. 4 shows an alternative arrangement to that shown in FIG. 3, with similar components having similar reference numerals. The major difference is that whereas the arrangement shown in FIG. 3 has an indirect-acting boost-level indicator 45, in which the protruding spindle 44, with its parallel and tapered portions, acts as a primary maximum fuel-injection stop, the arrangement shown in FIG. 4 provides for the boost-level sensor to act directly on the pump control.

Thus, in the embodiment of FIG. 4, the moving spindle of the boost indicator (not shown) forms part of a main plunger 81 which moves to the left, as drawn, as the boost level rises. This allows the fuel pump maximum-fuel stop to provide more fuel as the boost pressure rises. With no boost, the main plunger 81 is disposed toward the right and a secondary, inner plunger 82 is pushed out to the broken-line position shown at the right by a control spring 83, where the inner plunger acts as the naturally-aspirated maximum fuel stop. If now the fuel control is moved to the left with enough force to overcome the spring 83, the inner plunger 82 will be pushed a distance "d," to the position shown in solid lines in FIG. 4, where a passage 84 drilled through the inner plunger 82 becomes aligned with passage 85 in the main plunger 81. Under these conditions, the transfer pressure fuel at the inlet 62 is released via the passageway 59 to the bypass outlet 64 and then to the fuel supply 17.

The time delay produced by pistons 68 and 74 of FIG. 4 occurs in the same manner as in the embodiment of FIG. 3, discussed above, and as the boost pressure rises, the main plunger 81 moves to the left, releasing the load in the spring 83 until the inner plunger 82 closes the passages 84 and 85, by which time the fuel-injection timing will have returned to its standard steady-state load and speed condition.

Figure 5:
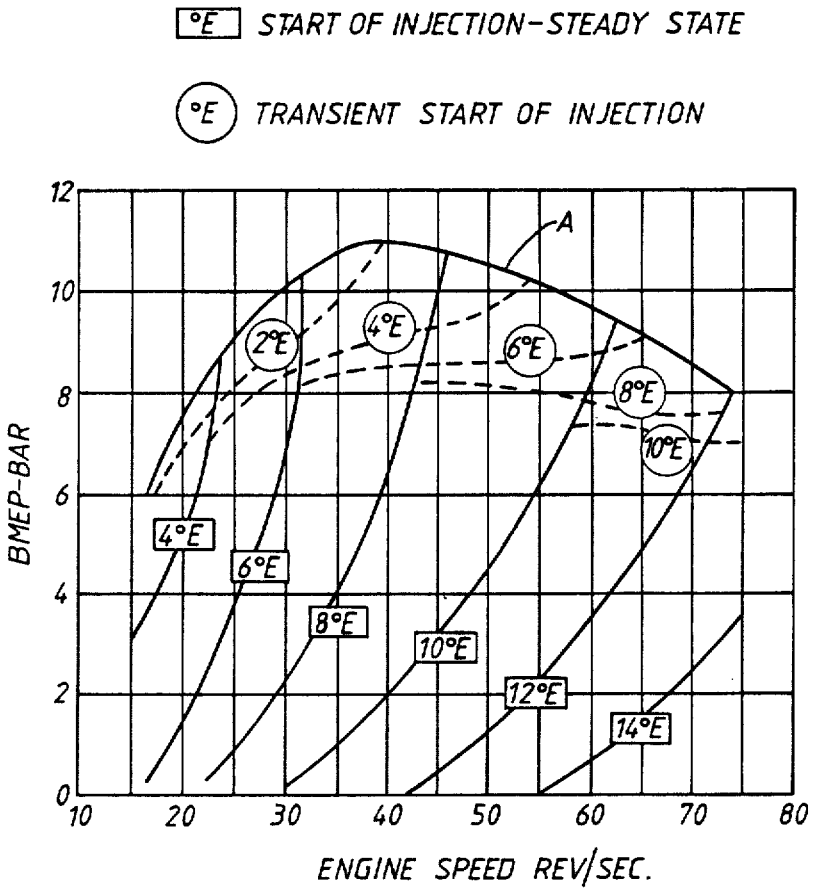
FIG. 5 is a graphical representation of a timing plan for a small, high-speed, indirect-injection diesel engine.

FIG. 5 shows a typical timing plan for a small, high-speed, indirect-injection automotive diesel engine. Curve A shows the maximum (full load) torque available with a typically matched turbocharger under normal steady-state conditions. This represents the maximum output available at each speed after any transients due to a change of speed and/or load have died away and a steady operating regime has been established. The specific shape of this curve is interrelated with the particular turbocharger characteristics involved, i.e., rotor size and inlet nozzle ring area as adjusted during empirical matching tests, and with the engine's own breathing characteristics, i.e., volumetric efficiency at inlet manifold conditions over the speed range, together with such factors as the fuel-injection rate selected, and the maximum permitted fuel-injection quantity, which is most often set at the point of exhaust smoke onset.

The upwardly-sloping full lines, labelled "4°", "6°", etc., in rectangular boxes, are the optimized fuel-injection start of injection timings, as determined experimentally with steady-state operation at various loads and speeds and incorporated in the standard fuel pump automatic timing settings. Thus, by way of example, at 6 Bar and 22 rev/s an injection advance of 4° E. is provided, which must be increased at the same load to 10° E. at 55 rev/s. This is largely due to the fact that combustion ignition delay is approximately constant in time but as the speed rises the delay time occupies more crankshaft degrees. Thus, for combustion to start at roughly the same given crankshaft position, the injection start must be advanced. Similarly, some adjustment of injection timing is found to be required as load is increased at a constant speed.

The dotted curves labelled "2° E", "4° E", etc., in circles illustrate the type of characteristic start of injection timing it is believed will be required in a system according to the invention during transient accelerations. The departure of the bottom of the dotted curves from the full-line curves occurs when the naturally-aspirated maximum fuel stop is reached, i.e., when the abutment 43 at the top end of lever 39 meets the bottom parallel-sided part of the spindle 44. If a curve were drawn to connect the points of departure of the dotted curves from the solid-line curves, it would give the naturally-aspirated full-load torque/speed characteristic.

If increased fuelling beyond the naturally-aspirated level is suddenly demanded by the driver, the spring-loaded pivot 56 of the lever 39 moves to the left, causing the control unit 51 to come into action. As a result, the drop in control pressure in line 53 causes the injection timing to retard and to then substantially follow the dotted curves as the engine boost and speed rise. When the desired boost pressure is reached, the lever 39 will have moved to the right as the abutment 43 moves along the slope 49 on the boost-sensing unit spindle 44 with rising boost pressure, caused by the speeding-up of the turbocharger. This releases the load on the pivot 56, enabling the control unit 51 to return to its cut-off position. alternatively, if the acceleration is maintained for a long Period, the delay valve 42 in the control unit 51 closes. In each case, the injection timing is then returned to that indicated by the solid curves as the system's control pressures are returned to their steady-state values.

It is to be understood that the above detailed description is merely that of certain exemplary preferred embodiments of the invention, and that numerous changes, alterations and variations may be made without departing from the underlying concepts and broader aspects of the invention as set forth in the appended claims, which are to be interpreted in accordance with the established principles of patent law, including the doctrine of equivalents.

The embodiments of the invention in which an exclusive property or privilege is claimed are defined as follows:

1. An improved fuel-supply system for a fuel-injected turbocharged internal-combustion engine, including means for improving acceleration response at low boost pressure with minimal smoking, said system comprising in combination: a fuel pump; a fuel distributor; a control valve; and fuel-injection timing means operably associated with said fuel distributor, for determining the timing of fuel distributed thereby; said means for improving acceleration response including a control unit and fluid-conduit means coupling said fuel pump to said fuel distributor via said control valve to convey combustion fuel serially therebetween; said fuel distributor being of a type to supply a predetermined quantity of fuel sequentially to individual injectors associated with individual cylinders of said engine under timing control by said injection timing means; means for sensing fuel pressure from said fuel pump and applying said pressure sense to said control unit, and for applying said pressure sense from said control unit to said fuel-injection timing device, for controlling the timing operation thereof by which fuel is supplied by said distributor to said injectors; said control unit including an actuating member; means for applying biasing forces to said actuator as a function of the amount of turbocharger boost pressure present and as a function of engine accelerator position; and means associated with said control unit and responsive to said actuator member, for modifying the fuel pressure sense applied to said injection timing device in response to said biasing forces in a manner causing retarding of the timing of the fuel injection to said engine when the latter is subjected to a demand for increased fuelling at boost pressure below a predetermined minimum level.

2. A fuel-supply system according to claim 1 wherein said fuel distributor is of the plunger type whose timing is determined by the position of a cam system and in which said timing-control device comprises a piston arranged to move said cam system against the force of a spring in dependence upon the magnitude of pressure conveyed to said piston from said control unit.

3. A fuel-supply system according to claim 1 wherein said control unit includes a fuel passageway having an inlet connected to an outlet of said fuel pump, an outlet connected to said timing-control device, and a bypass outlet, said control unit further including a valve means having a normally-closed condition in which said bypass outlet is isolated from said inlet and an open condition in which said inlet and bypass outlet are connected in communication with one another.

4. A fuel-supply system according to claim 3 including a turbocharger boost pressure sensor having an output which varies in relation to turbocharger boost pressure, and means for coupling said output to said valve means such that said output controls actuation of said valve means from said open condition to said closed condition in response to rising boost pressure following a demand for increased fuelling.

5. A fuel-supply system according to claim 4 including an operating member for said valve menas, and an actuator coupled to the engine accelerator control, said actuator being arranged to act on said operating member to actuate said valve means to said open condition upon a demand to increase fuelling, and said boost pressure sensor having an output member arranged to act on said operating member in a manner to cause said valve means to return to said closed condition as the boost pressure subsequently rises.

6. A fuel-supply system according to claim 4 wherein said valve means comprises a main plunger and a secondary plunger interacting with said main plunger to define said open and closed valve conditions, and including an actuator connected to the engine accelerator control, said actuator being arranged to urge said secondary plunger to a position causing said open condition upon a demand to increase fuelling, and said boost pressure sensor having an output member arranged to move said main plunger to valve-closed condition as said boost pressure subsequently rises.

7. A fuel-supply system according to claim 4 wherein said control unit includes a bore and a piston located in said bore, biasing means for urging said piston towards a position in which it closes said passageway, and means for moving said piston against said biasing means to an open position in response to sudden demands for increased fuelling.

8. In a fuel-supply system for a turbocharged diesel engine, of the general type having a fuel pump, a high-pressure fluid distributor, a control valve, and a timing-control device arranged to adjust the timing of the fuel injection, said pump arranged to convey fuel at an intermediate pressure via said control valve to said high-pressure fluid distributor, and said distributor being arranged to supply a predetermined quantity of fuel sequentially to individual injectors associated with individual cylinders of said engine on the particular timing basis dictated by said timing-control device, the improvement comprising: a control means for sensing fuel pressure from said pump and applying a proportional signal to said timing-control device under normal engine working condition; said control means operating to change said signal applied means timing-control device when said engine is subjected to a demand to increase fuelling uner conditions where turbocharger boost pressure is less than a predetermined minimum, to thereby cause retarding of the injection timing of the fuel distributed to said cylinders during the time such conditions of fuelling demand and low boost pressure persist; said control means additionally operating to further change said signal applied to said timing-control device to decrease the extent of injection timing retardation in response to rising turbocharger boost pressure resulting from the initial timing retardation.

9. The improvement in a fuel-supply system as recited in claim 8, and including means for sensing turbocharger boost pressure and providing a control signal to said control means which is representative of the magnitude of sensed boost pressure.

10. The improvement in a fuel-supply system as recited in claim 8, and including means for monitoring engine accelerator control operation and providing a control signal to said control means which is representative of accelerator control actuation.

11. The improvement in a fuel-supply system as recited in claim 8, and including means for sensing turbocharger boost pressure and providing a control signal which is representative of such pressure, means for monitoring engine accelerator control operation and providing a control signal which is representative of such operation, and means for receiving said two control signals and providing a resultant signal to said control means which is a function of both said control signals.

12. The improvement in a fuel-supply system as recited in claim 11, wherein at least one of said two means for providing control signals comprises a mechanical apparatus having a movable output element whose movements comprise the control signals produced by said means.

13. The improvement in a fuel-supply system as recited in claim 12, wherein both of said two means for providing control signals comprise a mechanical apparatus having a movable output element whose movements comprise the control signals produced by said means, and wherein said means for receiving said two control signals comprise mechanical motion-resolving means adapted to produce a resultant motion from the movements of said two output elements which is a composite of such movements.

* * * * *

UNITED STATES PATENT AND TRADEMARK OFFICE

CERTIFICATE OF CORRECTION

PATENT NO. : 4,709,676

DATED : December 1, 1987

INVENTOR(S) : Michael L. Monaghan

It is certified that error appears in the above-identified patent and that said Letters Patent is hereby corrected as shown below:

Column 5, Line 55;
"pen" should be -- open --.

Column 11, Claim 5, Line 66;
"menas" should be -- means --.

Column 12, Claim 8, Line 40;
"means" should be -- to said --

Column 12, Claim 8, Line 42;
"uner" should be -- under --.

Signed and Sealed this

Fourteenth Day of June, 1988

*Attest:*

DONALD J. QUIGG

*Attesting Officer*

*Commissioner of Patents and Trademarks*